US005410394A

United States Patent [19]

Wayman et al.

[11] Patent Number: 5,410,394

[45] Date of Patent: Apr. 25, 1995

[54] THREE ROLLER DESIGN ELIMINATES FREE SPAN BELT HEATING OF INTEGRAL HEATING FUSING BELT

[75] Inventors: William H. Wayman, Ontario; Rasin Moser, Fairport, both of N.Y.

[73] Assignee: Xerox Corporation, Stamford, Conn.

[21] Appl. No.: 168,833

[22] Filed: Dec. 16, 1993

[51] Int. Cl.[6] ..... G03G 15/20

[52] U.S. Cl. ..... 355/285; 219/216

[58] Field of Search ..... 355/282, 285, 290, 295; 219/216, 469, 470; 432/60; 430/124

[56] References Cited

U.S. PATENT DOCUMENTS

| | | | |
|---|---|---|---|
| 4,563,073 | 1/1986 | Reynolds | 355/284 |
| 4,565,439 | 1/1986 | Reynolds | 355/290 |
| 4,931,618 | 6/1990 | Nagata et al. | 219/216 |
| 5,084,738 | 1/1992 | Ishikawa | 355/285 |
| 5,115,279 | 5/1992 | Nishikawa et al. | 355/290 |
| 5,164,782 | 11/1992 | Nagayama et al. | 355/285 |
| 5,182,606 | 1/1993 | Yamamoto | 355/289 |
| 5,250,998 | 10/1993 | Ueda et al. | 355/285 |
| 5,262,834 | 11/1993 | Kusaka et al. | 355/285 |

FOREIGN PATENT DOCUMENTS

| | | | |
|---|---|---|---|
| 4-276783 | 10/1992 | Japan | 355/285 |
| 4-366875 | 12/1992 | Japan | 355/285 |

*Primary Examiner*—A. T. Grimley
*Assistant Examiner*—William J. Royer

[57] ABSTRACT

Three fuser rollers cooperate with a pressure roller to form an extended fusing zone through which a substrate carrying toner images passes with the toner images contacting fusing belt. Electrical power is applied to the three fuser rolls in such a manner that only the portions of the belt in the fusing zone are heated. Thus, the energy is concentrated only in the part of the fusing belt where it is needed for fusing the toner images on the final substrate. Thus, the free extent of the belt or in other words the portion of the belt outside of the fusing zone remains unheated.

22 Claims, 3 Drawing Sheets

THREE ROLLER DESIGN ELIMINATES FREE SPAN BELT HEATING OF INTEGRAL HEATING FUSING BELT

BACKGROUND OF THE INVENTION

This invention relates to the art of forming powder images and, more particularly, to heat and pressure belt fusing.

In the art of xerography or other similar image reproducing arts, a latent electrostatic image is formed on a charge-retentive surface which may comprise a photoconductor which generally comprises a photoconductive insulating material adhered to a conductive backing. When the image is formed on a photoconductor, the photoconductor is first provided with a uniform charge after which it is exposed to a light image of an original document to be reproduced. The latent electrostatic images, thus formed, are rendered visible by applying any one of numerous pigmented resins specifically designed for this purpose.

It should be understood that for the purposes of the present invention the latent electrostatic image may be formed by means other than by the exposure of an electrostatically charged photosensitive member to a light image of an original document. For example, the latent electrostatic image may be generated from information electronically stored or generated, and this information in digital form may be converted to alphanumeric images by image generation electronics and optics. However, such image generation electronic and optic devices form no part of the present invention.

In the case of a reusable photoconductive surface, the pigmented resin, more commonly referred to as toner which forms the visible images is transferred to a substrate such as plain paper. After transfer the images are made to adhere to the substrate using a fuser apparatus. To date, the use of simultaneous heat and contact pressure for fusing toner images has been the most widely accepted commercially, the most common being ones that utilize a pair of pressure engaged rolls.

Heretofore, it has been necessary with the foregoing type of fuser to heat the fuser not only when images are being fused but also during standby when images are not being fused. This is because of the long delay of raising the large thermal mass up to fusing temperature if the heat supply was turned off during standby. Such delays would not be tolerated by the user even though operating the fuser in such a manner would eliminate a substantial waste of energy.

Elimination of fuser standby power has been accomplished in prior art devices such as flash fusers and cold pressure fusers. Both of these types of fusers, however, exhibit other drawbacks. For example, cold pressure fusers exhibit poor quality images and they significantly limit the process speed of imaging machines.

Flash fusers create undesirable effluents and they work very poorly with colored toners, especially the lighter colored ones. Also, the optical density of flash fused images is unsatisfactory. Like cold pressure fusers, flash fusers limit the process speed of the imaging machines in which they are used.

Belt fusers are exemplified by the following publications and patent applications:

U.S. patent application Ser. No. 08/168,835, filed on Dec. 16, 1993 which is assigned to the same assignee as the instant invention relates to a belt fuser wherein three fuser rollers cooperate with a pressure roller to form an extended fusing zone through which a substrate carrying toner images passes with the toner images contacting fusing belt. Electrical power is applied to the three contact rolls in such a manner that only the portions of the belt in the fusing zone are heated. Thus, the energy is concentrated only in the part of the fusing belt where it is needed for fusing the toner images on the final substrate. Thus, the free extent of the belt or in other words the portion of the belt outside of the fusing zone remains unheated.

To ensure good electrical contact in the presence of silicone oil contamination on the electrically resistive inner surface of the fusing belt, the contact rollers are textured by knurling, bead blasting or other suitable means.

U.S. patent application Ser. No. 08/169,836, filed on Dec. 16, 1993, which is assigned to the same assignee as the instant invention relates to a belt fuser wherein three fuser rollers cooperate with a pressure roller to form an extended fusing zone through which a substrate carrying toner images passes with the toner images contacting a fusing belt. Electrical power is applied to the three fuser rolls in such a manner that only the portions of the belt in the fusing zone are heated to a predetermined operating temperature in accordance with a setpoint temperature. The free extent of the belt or in other words the portion of the belt outside of the fusing zone is adapted to be heated to various operating temperatures in order to produce prints with different gloss as desired.

U.S. patent application Ser. No. 08/169,838, filed on Dec. 16, 1993, which is assigned to the same assignee as the instant invention relates to a power controller, which does not rely on the use of sensors such as thermistors to control the operating temperature of a belt fuser. It features various preset inputs to control: steady state watts/in, cold start boost watts/in, warmup and cooldown time constants.

The controller sets the desired power based on the on-off cycling of the system. There are no sensors used to measure fuser temperature. For a cold start, the steady state plus boost power is used, during warmup the boost level is exponentially decreased at a rate set by a warmup time constant. When at rest (with no applied power) the power setpoint is exponentially increased at a rate set by a cooldown time constant.

U.S. patent application Ser. No. 08/169,802, filed on Dec. 16, 1993, which is assigned to the same assignee as the instant invention relates to a belt fuser for fusing transparencies without having to resort to off-line methods and apparatus. The toner images which are formed on the transparency during the imaging process have time to cool prior to separation from a smooth-surfaced belt.

U.S. patent application Ser. No. 08/168,891, filed on Dec. 16, 1993, which is assigned to the same assignee as the instant invention relates to a belt fuser wherein three fuser rollers cooperate with a pressure roller to form an extended fusing zone. Electrical power is applied to the three fuser rolls in such a manner that only the portions of the belt in the fusing zone are heated. Thus, the energy is concentrated only in the part of the fusing belt where it is needed for fusing the toner images a final substrate. The free extent of the belt or in other words the portion of the belt outside of the three rollers remains unheated. Toner images are directly formed on or transferred to the unheated portion of the fusing belt.

The images carried by the belt are then moved through the fusing zone where the images are simultaneously fused and transferred to a final substrate.

U.S. Pat. No. 4,565,439 granted to Scott D. Reynolds on Jan. 21, 1986 relates to a belt fuser for fusing toner images. The fusing apparatus is characterized by the separation of the heat and pressure functions such that the heat and pressure are effected at different locations on a thin flexible belt forming the toner contacting surface. A pressure roll cooperates with a non-rotating mandrel to form a nip through which the belt and copy substrate pass simultaneously. The belt is heated such that by the time it passes through the nip its temperature together with the applied pressure is sufficient for fusing the toner images passing there through. The non-rotating mandrel is adapted to having its axis skewed relative to the axis of the pressure roll. A pair of edge sensors are provided for activating a mandrel skewing mechanism. Skewing of the mandrel by such mechanism effects proper belt tracking.

U.S. Pat. No. 4,563,073 granted to Scott D. Reynolds on Jan. 7, 1986 relates to a low mass heat and pressure fuser and release agent management system therefor.

U.S. Pat. No. 5,084,738 granted to Noriyoshi Ishikawa on Jan. 28, 1992 discloses a fusing apparatus having an electrically conductive film which moves in contact with a recording material to which a toner image has been transferred, a pressing roller for causing the film to be brought into contact with the recording material and a plurality of electrodes disposed along a nip between the film and the pressing roller at a position opposing this pressing roller. The electrically conductive film heats up substantially only in the nip as the result of an electrical conductance to this electrode. The toner image on the recording material is heated and fixed by the heat generated in the electrically conductive film positioned in the nip. In a modified embodiment of the foregoing fusing device, a fusing film is fabricated using a thin-film conductive layer made by aluminum deposition or the like. The conductive layer is disposed on the side of a base film comprising carbon black added to a polycarbonate that will contact the transfer material on which a picture image is carried. Power is supplied between a first electrode and a second electrode. Joule heat is produced in the thickness direction of the fusing film.

U.S. Pat. No. 5,182,606 granted on Jan. 26, 1993 discloses an image fusing apparatus including a heater; a film movable with a recording material, in which the recording material has a toner image thereon which is heated through the film by heat from the heater; and the film has a heat resistive resin base layer containing inorganic electrically insulative filler material and a parting layer containing electrically conductive filler material.

In a fusing arrangement similar to the one disclosed in the '738 patent but where an endless belt is substituted for the web heater element similar to the one disclosed in the '606 patent, resistive heating is generated in both the fusing zone and the belt free span. In a continuous or endless belt fusing system, depending on the ratio of fusing zone length to the total belt length, up to 50% of the power may be dissipated by the belt free span.

BRIEF SUMMARY OF THE INVENTION

According to the present invention, a compact, lightweight fuser is provided which reaches fusing temperature and power in less than one second. The fuser of the present invention utilizes a thin polymeric film in the form of a seamless belt with an electrically resistive coating.

Three fuser rollers cooperate with a pressure roller to form an extended fusing zone through which a substrate carrying toner images passes with the toner images contacting the fusing belt. Electrical power is applied to the three contact rolls in such a manner that only the portions of the belt residing in the fusing zone are heated. Thus, the energy is concentrated only in the part of the fusing belt where it is needed for fusing the toner images on the final substrate. The free extent of the belt or in other words the portion of the belt outside of the fusing zone is not heated via the electrical power supplied to the three fuser rolls. To this end the free extent of the belt has no voltage applied across it due to the equal potential of the rollers that delimit the ends of the belt free span.

Electrically resistive coatings capable of withstanding fusing temperatures include metal oxide, graphite and/or carbon black loaded fluoropolymers or silicones. Joule heating may also be generated using an electrically resistive substrate film such as Kapton XC from Du Pont Chemical, thus eliminating the need for a separate resistive layer.

Advantages of this approach to fusing include true instant-on capability, low subsystem mass, compactness, zero standby power, reduced machine heat output and design flexibility inherent in belt concepts including variable fusing dwell times.

DETAILED DESCRIPTION OF THE DRAWINGS

FIG. 1*a* is a schematic illustration of a fusing apparatus according to the invention.

FIG. 1*b* is an enlarged view depicting a fuser belt.

DESCRIPTION OF THE PREFERRED EMBODIMENT OF THE INVENTION

Figure 4:
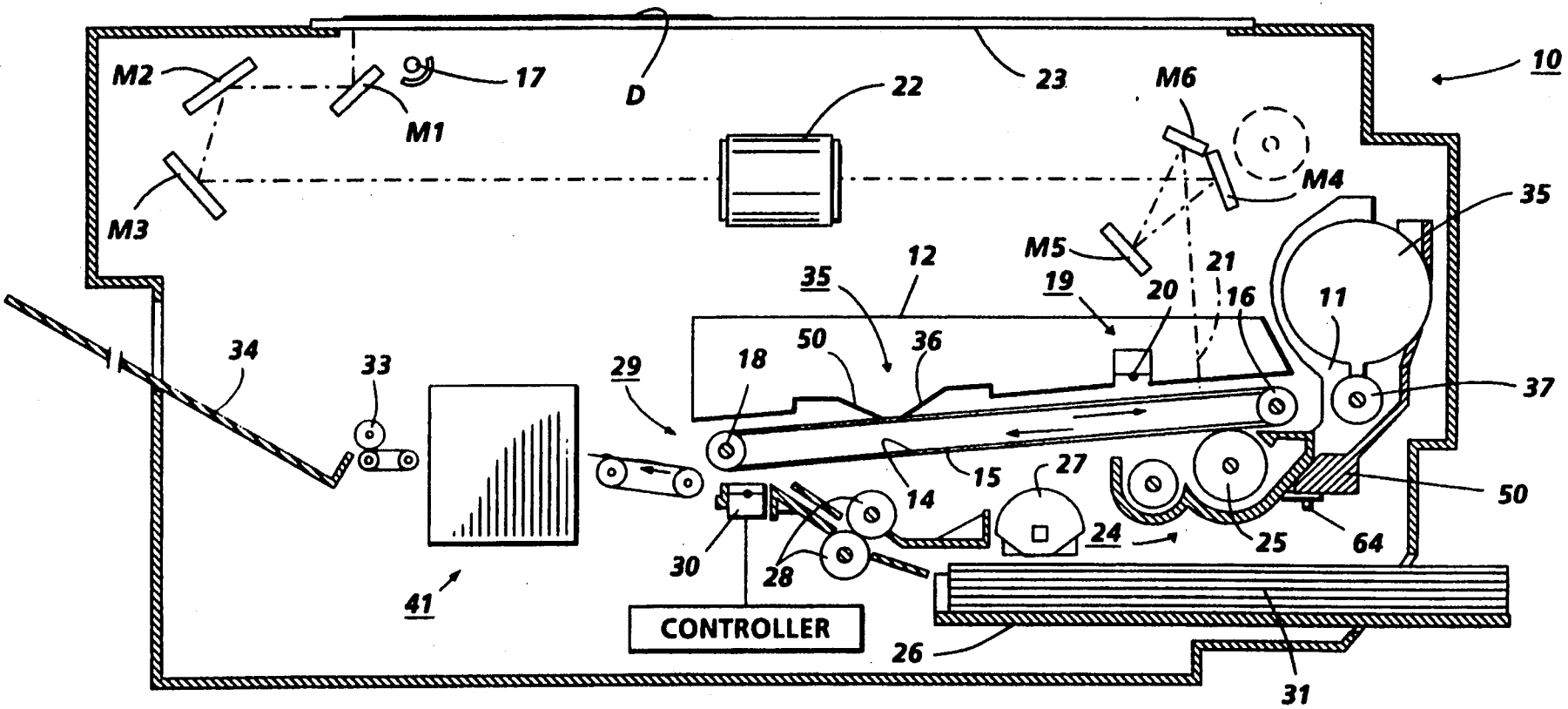
FIG. 4 is a schematic illustration of an imaging apparatus in which the fuser apparatus of FIG. 1*a* can be utilized.

Referring now to FIG. 4, there is shown by way of example, an automatic electrostatographic reproducing machine 10 which includes a removable processing cartridge 12. The reproducing machine depicted in FIG. 4 illustrates the various components utilized therein for producing copies from an original document. Although the invention is particularly well adapted for use in automatic electrostatographic reproducing machines, it should become evident from the following description that it is equally well suited for use in a wide variety of processing systems including other electrostatographic systems such as printers and is not necessarily limited in application to the particular embodiment shown herein.

The reproducing machine 10 illustrated in FIG. 4 employs a removable processing cartridge 12 which may be inserted and withdrawn from the main machine frame. Cartridge 12 includes an image recording belt-like member 14 the outer periphery of which is coated with a suitable photoconductive material 15. The belt or charge retentive member is suitably mounted for revolution within the cartridge about driven transport roll 16, around idler roll 18 and travels in the direction indicated by the arrows on the inner run of the belt to bring the image bearing surface thereon past a plurality of xerographic processing stations. Suitable drive means such as a motor, not shown, are provided to power and coordinate the motion of the various cooperating machine components whereby a faithful reproduction of the original input scene information is recorded upon a sheet of final support material 31, such as paper or the like.

Initially, the belt 14 moves the photoconductive surface 15 through a charging station 19 wherein the belt is uniformly charged with an electrostatic charge placed on the photoconductive surface by charge corotron 20 in known manner preparatory to imaging. Thereafter, the uniformly charged portion of the belt 14 is moved to exposure station 21 wherein the charged photoconductive surface 15 is exposed to the light image of the original input scene information, whereby the charge is selectively dissipated in the light exposed regions to record the original input scene in the form of an electrostatic latent image.

The optical arrangement creating the latent image comprises a scanning optical system including lamp 17 and mirrors M1, M2, M3 mounted to a scanning carriage (not shown) to scan an original document D on an imaging platen 23. Lens 22 and mirrors M4, M5, M6 transmit the image to the photoconductive belt in known manner. The speed of the scanning carriage and the speed of the photoconductive belt are synchronized to provide faithful reproduction of the original document. After exposure of belt 14 the electrostatic latent image recorded on the photoconductive surface 15 is transported to development station 24, wherein toner is applied to the photoconductive surface 15 of the belt 14 rendering the latent image visible. The development station includes a magnetic brush development system including developer roll 25 utilizing a magnetizable developer mix having course magnetic carrier granules and toner colorant particles supplied from developer supply 11 and auger transport 37.

Sheets 31 of final support material are supported in a stack arranged on elevator stack support tray 26. With the stack at its elevated position, a segmented feed and sheet separator roll 27 feeds individual sheets therefrom to a registration pinch roll pair 28. The sheet is then forwarded to a transfer station 29 in proper registration with the image on the belt and the developed image on the photoconductive surface 15 is brought into contact with the sheet 31 of final support material within the transfer station 29 and the toner image is transferred from the photoconductive surface 15 to the contacting side of the final support sheet 31 by means of transfer corotron 30. Following transfer of the image, the final support material which may be paper, plastic, etc., as desired, is separated from the belt due to the beam strength of the support material 31 as it passes around the idler roll 18. The sheet containing the toner image thereon is advanced to fusing station 41 comprising a seamless, heated fuser belt structure 52, pressure roll 54 and a plurality of fuser roll structures 56, 58 and 60 (FIG. 1*a*).

Although a preponderance of toner powder is transferred to the final support material 31, invariably some residual toner remains on the photoconductive surface 15 after the transfer of the toner powder image to the final support material. The residual toner particles remaining on the photoconductive surface after the transfer operation are removed from the belt 14 at a cleaning station 35 which comprises a cleaning blade 36 in scraping contact with the outer periphery of the belt 14. The particles so removed are contained within cleaning housing (not shown) which has a cleaning seal 50 associated with the upstream opening of the cleaning housing. Alternatively, the toner particles may be mechanically cleaned from the photoconductive surface by a cleaning brush as is well known in the art.

It is believed that the foregoing general description is sufficient for the purposes of the present invention to illustrate the general operation of an automatic xerographic copier 10 which can embody the apparatus in accordance with the present invention.

Figure 1A:
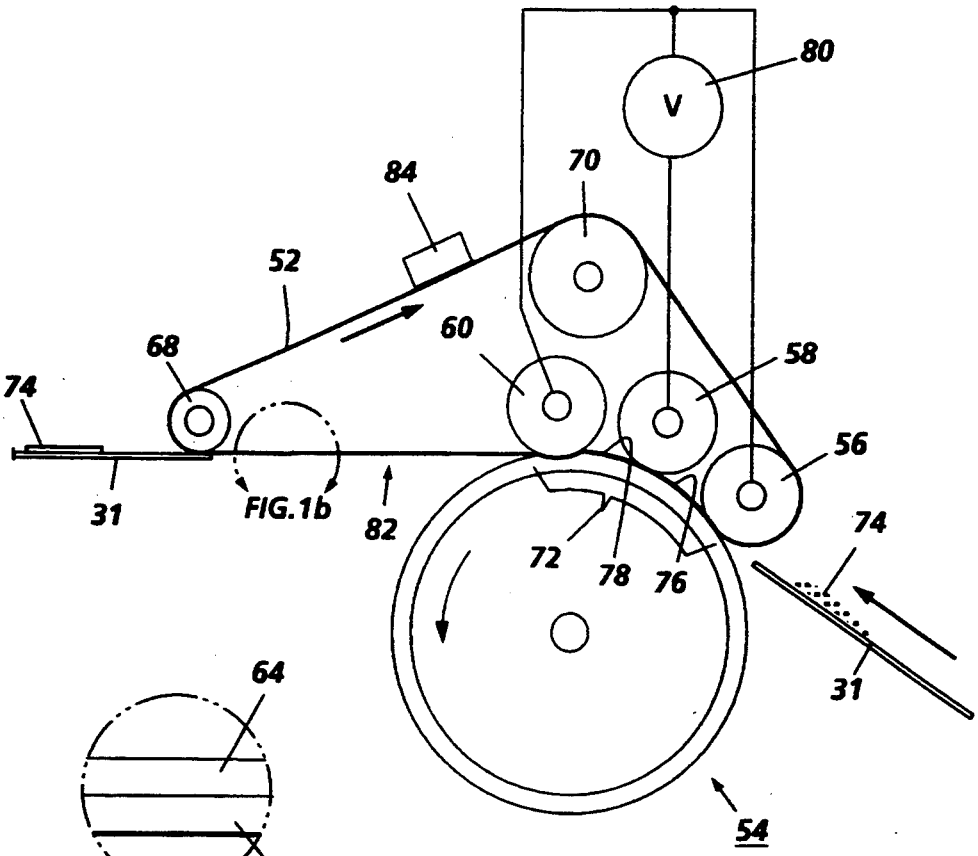
Figure 1B:
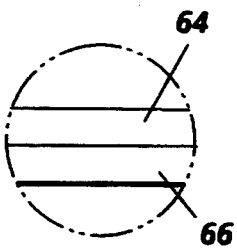

As disclosed in FIG. 1*a*, the fusing apparatus according to the present invention comprises a seamless belt structure 52 having an electrically resistive polyimide layer 64 and a release layer 66. The belt is entrained about the fuser rollers 56, 58 and 60 as well as a stripping roller 68 and an idler roller 70. The rollers 56, 58 and 60 are electrically conductive contact rollers which are electrically biased for applying voltages across a portion of the belt structure 52 which physically contacts these rollers. By contact it is meant that these rollers contact the electrically resistive polyimide layer 64. The use of a seamless belt construction is an important aspect of the invention in that a seamed belt is subject to arcing and wear at each make and break with the contact rollers. When a seamless belt construction is used there is no breaking of electrical contact to the belt thereby eliminating arcing and wear.

A pressure roller 54 cooperates with the rollers 56, 58 and 60 with a portion of the belt disposed therebetween to form a fusing zone 72 through which substrates or sheets 31 carrying toner images 74 thereon are passed for fusing the toner images 74 to the substrates. The roller 70 serves as an idler or belt steering roller while the roller 68 serves as a stripping roller. A total nip pressure of approximately 50 lbs. is exerted between the fuser roll 60 and the pressure roll 54 by conventional structure used for that purpose.

Figure 2:
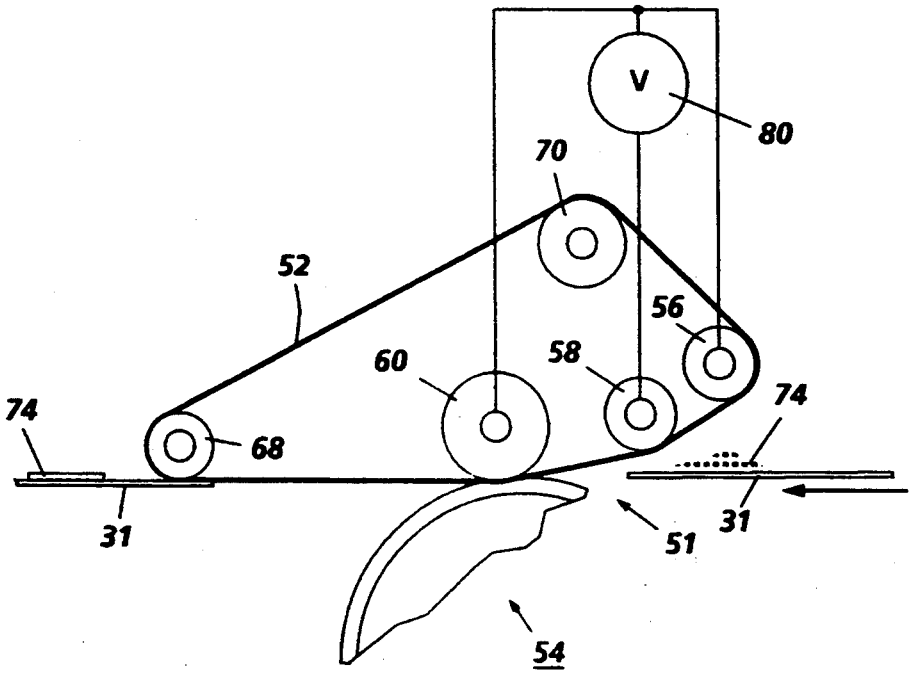
FIG. 2 is a schematic illustration of a modified embodiment of the invention illustrated in FIG. 1*a*.

Alternatively, fusing rollers 58 and 56 need not necessarily form a nip with pressure roller 54 as shown in FIG. 2. As illustrated therein a fly-in zone 51 is provided by the positioning of the rollers 56 and 58 as shown in FIG. 2. As will be noted, many of the components from FIG. 1*a* have been omitted since the they are not needed to illustrate the fly-in feature designated by reference character 51.

Figure 3:
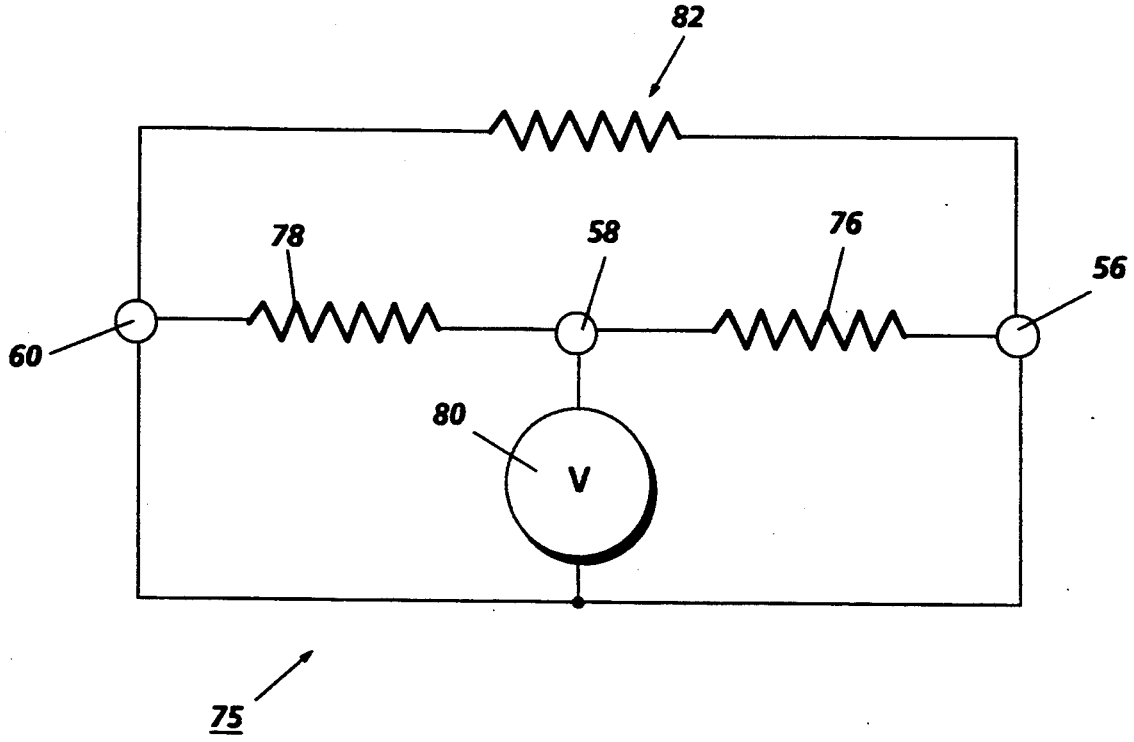
FIG. 3 is a schematic diagram of circuit for enabling the fuser apparatus of FIG. 1*a* to function in accordance with the present invention.

An electrical circuit 75 (FIG. 3) for applying power to belt segments 76 and 78 in the fusing zone 72 (FIG. 1*a*) comprises an AC power source 80 electrically connected to the three conductive fuser rollers 56, 58 and 60. The voltage is applied between the fusing zone entrance roller 56 and the center roller 58 and between the fusing zone exit roller 60 and the center roller as depicted in FIG. 3. Since the entrance and exit rollers are connected together at equal potential the non-fusing zone portion or segment 82 which does not contact any of the rollers 56, 58 and 60 is not heated.

A pad 84 containing a suitable release agent material such as silicone oil is supported in wiping contact with the surface of the belt 52. Thus, the belt surface is thinly coated with silicone oil to prevent toner powder particles from adhering to it.

The above described fuser was reduced to practice using a 50 micron polyimide substrate coated with a 40 micron layer of carbon and graphite loaded fluoropolymer with resistivity of approximately 170 ohms/square. Passing this belt through rollers distanced by 2.25 cm with a voltage differential of 120 VAC developed power of 37 w/cm across the process width. High density (2.0+mg/cm$^2$) color images were well fused at process speeds of 15 cm per second per second, equivalent to 40 copies per minute.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

We claim:

1. A heat and pressure fuser for fusing toner images onto substrates, said fuser comprising:

an electrically resistive belt;

a plurality of rollers for supporting said belt for movement in an endless path;

a pressure roller cooperating with some of said plurality of rollers to form an extended fusing zone therebetween; and means for effecting heating of only a portion of said belt, said only a portion of said belt being in said extended fusing zone.

2. Apparatus according to claim 1 wherein said means for effecting heating comprises three conductive fusing zone forming rollers and means for applying a voltage to said three rollers.

3. Apparatus according to claim 2 wherein one of said plurality of rollers comprises a stripping roller positioned remotely from said fusing zone whereby a free extent of said belt between said stripping roller and said fusing zone cools with toner images prior to stripping.

4. Apparatus according to claim 3 wherein said stripping roller is electrically isolated from said voltage supplied to said fusing zone forming rollers.

5. Apparatus according to claim 3 wherein said stripping roller is at equal potential with one of said fusing zone forming rollers.

6. Apparatus according to claim 5 wherein two of said fusing zone forming rollers are at equal electrical potential for eliminating heating of said belt outside of said fusing zone.

7. Apparatus according to claim 6 wherein said belt comprises a polyimide member.

8. Apparatus according to claim 7 wherein said polyimide member is provided with an electrically resistive layer of graphite and carbon loaded fluoropolymer.

9. Apparatus according to claim 8 wherein said resistive layer has a resistivity of between 150 and 1000 ohms per square.

10. Apparatus according to claim 6 wherein said belt contacting said fusing zone forming roller comprises a electrically resistive polyimide member.

11. Apparatus according to claim 10 wherein said electrically resistive polyimide member has a resistivity of approximately 150–1000 ohms/square.

12. A method for fusing toner images onto substrates, said method including the steps of:

providing an electrically resistive belt;

using a plurality of rollers, supporting said belt for movement in an endless path;

supporting a pressure roller for cooperating with some of said plurality of rollers to form an extended fusing zone therebetween; and effecting heating of only a portion of said belt, said only a portion of said belt being in said extended fusing zone.

13. The method according to claim 12 wherein said step for effecting heating comprises three conductive fusing zone forming rollers and means for applying a voltage to said three rollers.

14. The method according to claim 13 further including a step of providing a stripping roller positioned remotely from said fusing zone whereby the free extent of said belt between said stripping roller and said fusing zone cools with toner images prior to stripping.

15. The method according to claim 14 wherein said stripping roller is electrically isolated from the power supplied to said fusing zone forming rollers.

16. The method according to claim 14 wherein said stripping roller is at equal potential with one of said fusing zone forming rollers.

17. The method according to claim 16 wherein two of said fusing zone forming rollers are at equal electrical potential for eliminating heating of said belt outside of said fusing zone.

18. The method according to claim 17 wherein said belt comprises a polyimide member.

19. The method according to claim 18 wherein said polyimide member is provided with an electrically resistive layer of graphite and carbon loaded fluoropolymer.

20. The method according to claim 19 wherein said resistive layer has a resistivity of between 150 and 1000 ohms per square.

21. Method according to claim 17 wherein a belt surface contacting said toner images comprises a release layer coated on a electrically resistive polyimide member.

22. The method according to claim 21 wherein said electrically resistive polyimide member has a resistivity of approximately 150–1000 ohms/square.

* * * * *